United States Patent [19]

Skinner

[11] 3,943,902

[45] Mar. 16, 1976

[54] FUEL INJECTION PUMPING APPARATUS

[75] Inventor: Robert Thomas John Skinner, High Wycombe, England

[73] Assignee: C. A. V. Limited, Birmingham, England

[22] Filed: July 5, 1974

[21] Appl. No.: 486,108

[30] Foreign Application Priority Data

July 13, 1973 United Kingdom ..... 33561/73

[52] U.S. Cl. .....123/139 AQ; 123/139 AR; 123/140 FG

[51] Int. Cl.[2] ..... F02M 39/00

[58] Field of Search 123/139 AQ, 139 AR, 139 AC, 123/139 AD, 139 AE, 139 AN, 140 R, 140 FG

[56] References Cited

UNITED STATES PATENTS

| | | | |
|---|---|---|---|
| 2,833,263 | 5/1958 | Evans | 123/139 AQ |
| 2,902,017 | 9/1959 | Kemp | 123/139 AQ |
| 3,051,154 | 8/1962 | Kemp | 123/139 AQ |
| 3,116,728 | 1/1964 | Evans | 123/139 AQ |
| 3,416,505 | 12/1968 | Barber | 123/139 AQ |
| 3,433,159 | 3/1969 | Kemp | 123/139 AQ |
| 3,447,520 | 6/1969 | Drori | 123/139 AQ |
| 3,552,366 | 1/1971 | Kemp | 123/139 AQ |

*Primary Examiner*—Charles J. Myhre
*Assistant Examiner*—Daniel J. O'Connor
*Attorney, Agent, or Firm*—Kane, Dalsimer, Kane, Sullivan and Kurucz

[57] ABSTRACT

A fuel injection pumping apparatus comprises an injection pump which is driven in timed relationship with the associated engine, and a feed pump which supplies fuel under pressure to the injection pump. A throttle member controls the quantity of fuel which is supplied to the injection pump and a fluid pressure operable piston which is movable against the action of a spring to advance the timing of injection of fuel to the engine, the piston being subjected to the outlet pressure of the feed pump. A fluid pressure operable stop member is provided which when the apparatus is at rest, positions the piston to provide the correct timing of injection of fuel for starting purposes.

4 Claims, 2 Drawing Figures

FUEL INJECTION PUMPING APPARATUS

This invention relates to liquid fuel injection pumping apparatus for supplying fuel to internal combustion engines, and of the kind comprising an injection pump driven in timed relationship with the associated engine, a feed pump for supplying fuel under pressure to the injection pump at a pressure which varies in accordance with the speed at which the apparatus is driven, a throttle member for controlling the quantity of fuel supplied to the injection pump and thereby controlling the quantity of fuel supplied to the associated engine, and fluid pressure operable means for controlling the timing of delivery of fuel by the injection pump.

The object of the invention is to provide such an apparatus in a simple and convenient form.

According to the invention, in a fuel injection pumping apparatus of the kind specified, said fluid pressure operable means comprises a fluid pressure operable piston which is movable against the action of resilient means to advance the timing of injection of fuel to the engine, the piston being moved by fuel under pressure from the outlet of the feed pump, and a fluid pressure operable stop member which when the apparatus is at rest, positions the piston to provide the correct timing of injection of fuel for starting purposes.

Figure 1:
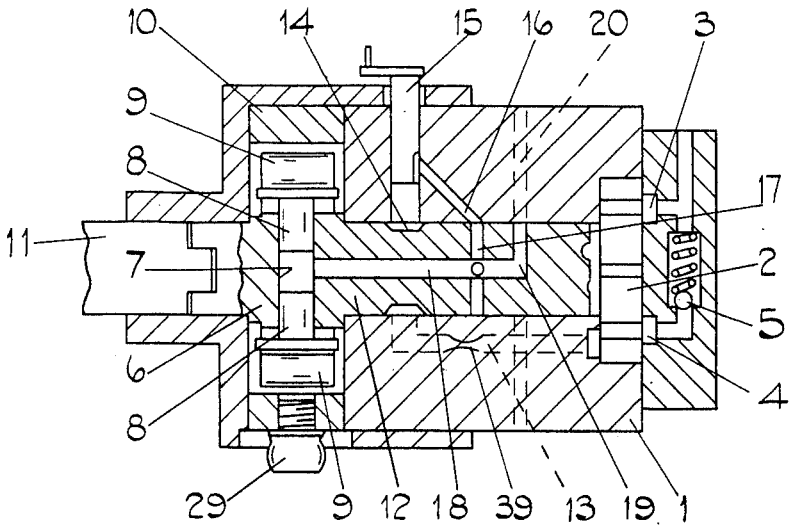
Figure 2:
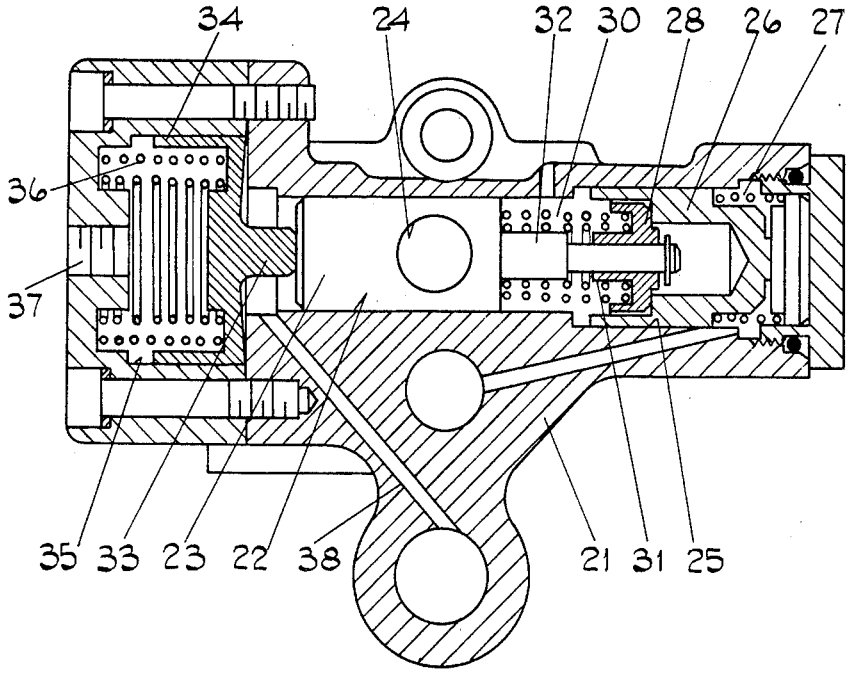

One example of a liquid fuel injection pumping apparatus in accordance with the invention will now be described with reference to the accompanying drawings, in which:

FIG. 1 is a sectional side elevation showing one form of pumping apparatus to which the invention can be applied, and FIG. 2 shows in sectional plan view a portion of the apparatus not seen in FIG. 1.

With reference to the drawings, there is provided a body part 1 which at one end contains a feed pump 2 of the kind comprising a rotary impeller provided with vanes. The inlet 3 and outlet 4 of this pump are interconnected through a relief valve 5 which regulates the pressure of fuel delivered to the rest of the apparatus in a manner dependent upon the speed at which the feed pump is driven. At the other end of the body part is contained a fuel injection pump which comprises a rotary head 6 formed at one end of a distributor 12 which serves to interconnect the rotary parts of the feed and injection pumps. Formed in the head is a transverse bore 7 containing a pair of reciprocable plungers 8 which through rollers 9 at their outer ends, co-operate with a surrounding annular cam 10. Furthermore, the distributor is adapted to be driven in synchronism with an engine with which the apparatus is associated, through a drive shaft 11.

Fuel from the feed pump 2 is fed through a passage 13 in the body part to an annular groove 14 in the periphery of the distributor and thence by way of a throttle valve 15 to a passage 16 in the body part which registers in turn as the distributor rotates, with a plurality of radially disposed passages 17 formed in the distributor. The passages 17 are in communication with an axial passage 18 in the distributor which opens at one end into the bore 7 in the head. Also extending from the axial passage 18 is a radial passage 19 which is adapted to register in turn and as the distributor rotates with a plurality of outlet ports 20 formed in the body part and which are adapted for connection to the injection nozzles respectively of the cylinders of the associated engine.

The apparatus so far described, is well known and operates in the following manner. Fuel from the feed pump is fed intermittently by way of the throttle valve to the axial passage 18 in the distributor and thus serves to move the plungers of the injection pump outwardly. At appropriate instants in the cycle, the plungers are moved inwardly by the action of the cam and thereby serve to discharge fuel in turn to the engine cylinders.

Connected to the body part is an extension 21 in which is formed a cylinder 22. Located within the cylinder is a piston 23 in which is formed an aperture 24 the latter when the extension 21 is secured to the body part, engaging an outwardly extending peg 29 on the annular cam 10.

Also provided is a second bore 25 which is formed co-axially with the first bore, but which has a slightly larger diameter. Located in this bore is a further piston member 26 and this is urged towards the piston 23 by means of a coiled compression spring 27. Moreover, engaging the piston 26 is a spring abutment 28, and interposed between the spring abutment 28 and the piston 23 is a pair of springs 30. The maximum extension of the springs 30 is controlled by a peg mounted on the piston 23 and extending through the abutment 28, and having at its end a spring washer or the like. Moreover, the abutment 28 is provided with a projection 31 which can engage with an enlarged portion 32 of the peg.

Also provided is a fluid pressure operable stop 33 for engagement with the end of the piston 23 remote from the springs. The stop 33 is mounted on a piston member 34 which is located within a bore 35 formed co-axially with the other bores but having a diameter considerably larger than the diameters of the other bores. The stop member 33 is urged towards the piston 23 by means of springs 36 and the space accommodating the springs 36 communicates with a drain by way of an aperture 37. A shock absorbing valve may be connected to the aperture 37 to minimise movement of the piston member 34 due to the reaction of the rollers 9 with the cam lobes.

The space intermediate the piston member 34 and the piston 23 is in communication by way of a passage 38 with the outlet 4 of the feed pump. Moreover, the space containing the spring 27 and bounded in part by the piston 26 is in communication with the passage 13 within the body part of the apparatus downstream of a restrictor 39 but upstream of the throttle 14.

The spring 27 is weaker than the springs 36 so that in the rest position of the apparatus as shown in FIG. 2, the stop 33 has moved its maximum extent under the action of the springs 36 and it bears against the piston 23 displacing it slightly against the action of the springs 27 and 30. This provides the required timing of injection of fuel for starting purposes. When the engine starts the pressure generated by the feed pump acting upon the large area of the piston 34 will immediately move same against the action of the springs 36, and this will then allow the piston 23 to move its maximum extent under the action of the springs 30 and 27. In other words after starting the engine, the timing of injection is slightly retarded.

As the speed of the engine increases, the piston 23 will move against the action of the springs thereby to advance the timing of injection. The actual timing of injection is responsive, both to the speed of the engine and also to the load of the engine. If the engine is running at high speed, but with low load, the throttle 15 will be more or less closed so that the pressure on the opposite sides of the restriction 39 will be practically the same. In this condition, the piston 26 will move under the action of the spring 27 and the fuel pressure to abut against the step defined between the bores 22 and 25. However, the piston 23 will move against the action of the springs 30 until the enlargement 32 on the peg contacts the projection 31 on the spring abutment 28. If now the load on the engine increases, so that the throttle valve is opened, the pressure on the downstream side of the restriction 39 will decrease so that the piston 26 will move as a unit with the piston 23 against the action of the spring 27 to further advance the timing of injection of fuel.

I claim:

1. A liquid fuel injection pumping means for supplying fuel to an internal combustion engine comprising; an injection pump, means for driving the pump in timed relationship with the associated engine, a feed pump including means for supplying fuel under pressure to the injection pump at a pressure which varies in accordance with the speed at which the apparatus is driven, a throttle member including means for controlling the quantity of fuel supplied to the injection pump and thereby controlling the quantity of fuel supplied to the associated engine, fluid pressure operable means for controlling the timing of delivery of fuel by the injection pump, said fluid pressure operable means comprising a fluid pressure operable piston which is movable against the action of resilient means to advance the timing of injection of fuel to the engine, means for moving the piston by fuel under pressure from the outlet of the feed pump, a fluid pressure operable stop member which when the apparatus is at rest, positions the piston to provide the correct timing of injection of fuel for starting purposes, further resilient means for effecting movement of the fluid pressure operable stop member to position the piston, said fluid pressure operable stop member including a further piston which is loaded by said further resilient means, means for subjecting the further piston to the pressure of fuel at the outlet of the feed pump, the area of the further piston subjected to the outlet pressure of the feed pump being greater than the area of the first mentioned piston which is subjected to the same pressure, means for providing a fluid pressure signal which varies in accordance with the quantity of fluid which is supplied to the engine, a third piston, means for subjecting the third piston to said fluid pressure with the third piston being positioned at the end of said first mentioned piston remote from said further piston, said third piston acting on said first mentioned piston through third resilient means, and said first mentioned resilient means acting on said third piston.

2. The invention in accordance with claim 1 wherein the apparatus includes a restrictor, means for providing fuel to flow through the restrictor to the injection pump from the feed pump, and said fluid pressure being derived from downstream of the restrictor.

3. The invention in accordance with claim 2 wherein the third resilient means comprises a coiled compression spring, and stop means on the apparatus for limiting the extent of compression of said spring.

4. The invention in accordance with claim 3 wherein further stop means is on the apparatus acting to limit the movement of the third piston under the action of said fluid pressure.

* * * * *